United States Patent [19]

Mann

[11] 4,085,555

[45] Apr. 25, 1978

[54] MULTI-STORIED BUILDING

[76] Inventor: Harald Mann, Rainerstr. 5, A-5021 Salzburg, Austria

[21] Appl. No.: 485,583

[22] Filed: Jul. 3, 1974

[30] Foreign Application Priority Data

Jul. 3, 1973 Austria ..... 5862/73

[51] Int. Cl.[2] ..... E04H 9/00; E04H 9/04; E04H 1/00

[52] U.S. Cl. ..... 52/169.6; 52/236.3

[58] Field of Search ..... 52/169, 234, 236, 30; 109/15

[56] References Cited

U.S. PATENT DOCUMENTS

| | | | |
|---|---|---|---|
| 1,629,787 | 5/1927 | Hackett | 52/169 X |
| 2,346,196 | 4/1944 | Starret | 52/169 X |
| 3,251,159 | 5/1966 | Trice | 52/169 X |

OTHER PUBLICATIONS

Architectural Record, "Dune Housing" p. 136 relied upon, 9-1972.

Engineering News Record, "Precast Bomb Shelter," 5-51, p. 27 relied on.

*Primary Examiner*—J. Karl Bell

*Attorney, Agent, or Firm*—Wenderoth, Lind & Ponack

[57] ABSTRACT

A building particularly adapted for protection against bombs and radiation has a plurality of floors and at least one front wall of windows. The ceilings of the floors are supported by a supporting framework, and the top floor is covered with an earth covering. The earth covering covers all floors except the front wall of windows and stretches from the cover of the top floor over at least one wall of the building in a sloping manner from the height of the top of the covering down to the natural ground level, and has exits accessible from each of the floors.

1 Claim, 4 Drawing Figures

MULTI-STORIED BUILDING

The present invention relates to a building, particularly designed for protection against bombs and radiation, which has a plurality of floors and at least one front wall of windows, the ceilings of the various floors being supported by a supporting framework and the top floor being covered with an earth covering.

The problem has been posed to provide every living room or space used, in contrast with the strictly stone and concrete structures of present towns, with a vegetational space of substantially the same size having a biologically protective effect against contamination of the environment.

SUMMARY OF THE INVENTION

This problem is resolved according to the invention in that the earth covering which covers all floors except a wall of windows thereof stretches from the cover of the top floor over at least one wall of the building in a sloping manner from the height thereof down to the natural ground level and is provided with exits accessible from the floors.

The building according to the invention differs from bunkers inasmuch as it is only partially covered with earth and has a wall front of windows. The object of the invention concerns, however, a permanently used living unit and not a completely covered off installation such as a bunker, used only in an emergencies.

The earth covering of the building according to the invention which leaves free the front wall of windows is arranged in the form of at least partially sloped surfaces so that hills are formed which can be planted with grass, bushes or trees. In any case the covering must be thick enough that also relatively large trees can grow thereon. It is therefore advantageous if the earth covering which can also consist of purified refuse material is covered with a layer of vegetable soil.

Furthermore it is advantageous in exits accessible from the floors lead to the covered slope. It is particularly advantageous to provide communication tunnels extending horizontally with respect to the walkable slope. As the slopes are only slightly inclined it is possible to reach the ground level from each floor without difficulty by passing through the communication tunnels. This would be an ideal passage for escape in case of fire or other catastrophe in the interior of the building. The automatic extending ladder and the jumping sheet, the only usual possibilities of escape left if staircases and lifts are unusable, are not necessary for the building according to the invention, as one can get to the open from each floor through the communication tunnels.

With regard to civilian air defense and protection against radiation it is suggested according to an additional advantageous characteristic feature of the invention to construct on each floor within the earth covering at least one room having gas-, radiation- and detonationproof walls and doors. It is convenient is such room lies closer to a covered wall of the building and communicates with the tunnel through a specially shaped door. In an emergency the users or inhabitants of the floor could retire to this protective room and could also escape through the tunnel.

If the building is arranged on a natural or artificial slope the rooms with the front wall of windows advantageously project from the slope whereas the protective rooms extend into the slope.

According to another construction it is also possible to protect the whole building or essential parts thereof against fall-out. To protect the window surfaces against radiation it is suitable to erect a further wall in front of the front wall of windows extending from the ground to the height of the ridge. This second wall may be provided with loggia-like recesses which in an emergency can be closed by roller blinds or the like. The space between the two walls can be used as a balcony etc.

BRIEF DESCRIPTION OF THE DRAWINGS

The building according to the invention will be described in detail with reference to the drawings, although it is not intended that the invention be restricted to these examples.

DETAILED DESCRIPTION OF THE INVENTION

Figure 1:
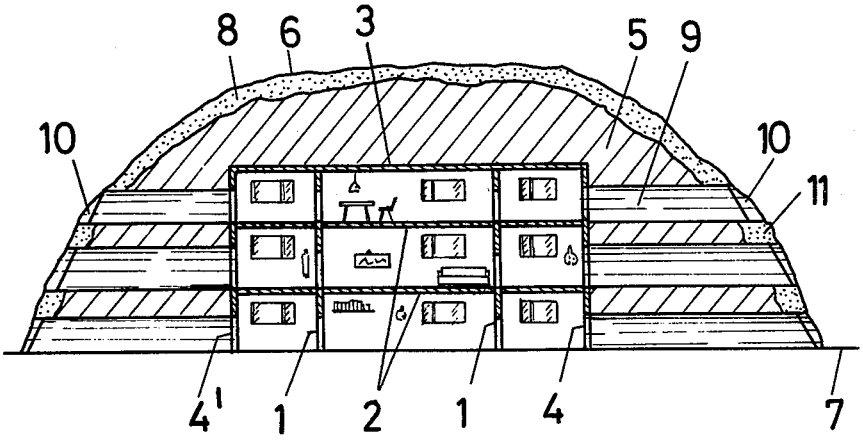
FIG. 1 is a diagrammatic sectional view of the building with an earth covering and layer of vegetable soil.

It becomes apparent from FIG. 1 that the building is constructed by floors or stories. The ceilings of the different floors are supported on supporting framework 1. The top floor is covered by an earth covering 5 with layer of vegetation supporting soil 8 applied there over. The earth covering, which should be thick enough to be able to plant trees thereon, extends from the height of the ridge 6 and slightly slopes down to natural ground level 7.

From opposite sides or ends of each floor a tunnel 9 leads horizontally through the earth covering and with exit 10 thereof opens to walkable slope 11 which slopes down to the ground level.

Figure 2:
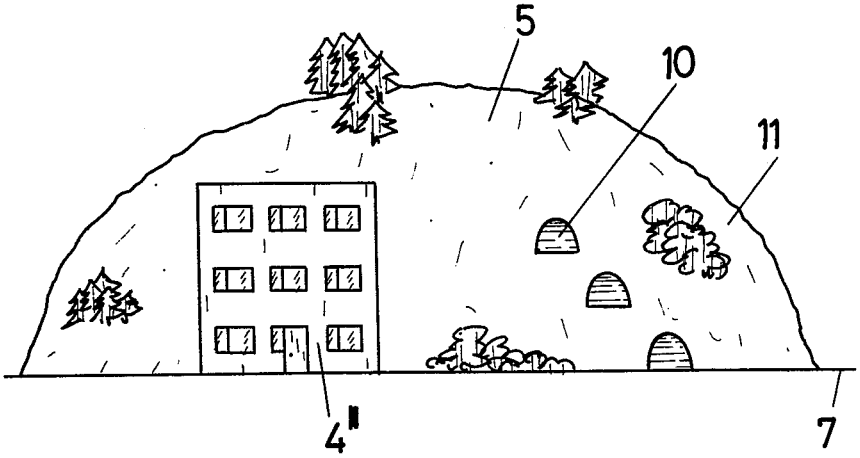
FIG. 2 is a front view showing the vertical front wall of windows and the walkable hill with the tunnel exits.

FIG. 2 shows front wall 4'' of windows of the building. The rest of the building is covered with earth covering 5.

Figure 3:
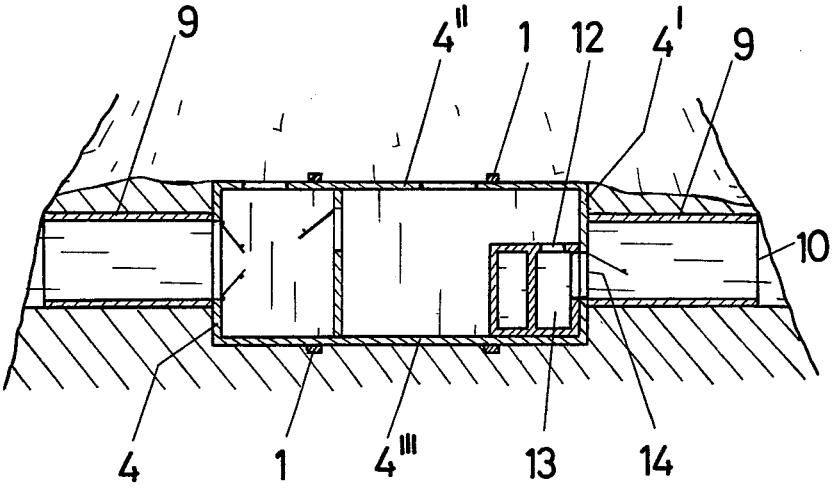
FIG. 3 is a diagrammatic sectional plan view of a floor.

FIG. 3 shows the construction of a protective room on one floor. The protective room 13 is enclosed by accordingly strong walls 12 and has a supply unit of its own, for instance, of water, light and ventilation. The protective room communicates with tunnel 9 through a shielded door 14. It is suitable to arrange protective room 13 close to a covered wall 4''' of the building and not close to the front wall of 4'' of windows.

Figure 4:
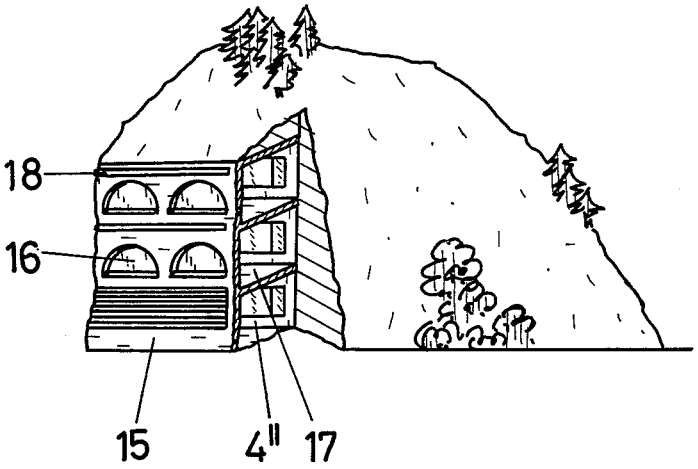
FIG. 4 is a diagrammatic perspective view of a protective wall in front of the wall front of windows.

FIG. 4 shows a further embodiment of the invention in which a further wall 15 is erected in front of the front wall 4'' of windows. Wall 15 has loggia-like recesses 16 which can be covered by radiationproof roller blinds 18 or the like. In normal condition the space between wall 15 and the front wall 4'' of windows can be used as a balcony 17.

The advantages of the building according to the invention are evident. The roofs are replaced by large green areas providing oxygen which areas can also be arranged in the form of recreation areas and play grounds. The planted slopes which have an inclination of about 20% to 30% are used for skiing and tobogganing in winter and for walking in summer. As the green areas arranged at the height of the ridge are far away from the street which leads along the ground level they are scarcely troubled by noise or dirt.

The fact that bunker-like rooms are planned within these living buildings and that in special cases also the front walls of windows can be safely shielded against radiation is of particular importance in the atomic age.

The lost heat resulting from the heating of the buildings may at least partially be used for warming the vegetation layer covering the building. As the vegetation is appreciated as a factor of protection of the environment the growth of the green areas should possibly be maintained during the colder seasons.

What I claim is:

1. A multi-storied residential building adapted for protection against bombs and radiation, said building comprising:

a plurality of stories having ceilings supported by a supporting framework, each of said stories having permanent living quarters;

a front wall having windows communicating with said living quarters;

an earth covering extending over the ceiling of the top of said stories and over all of the walls of said building except said front wall, said earth covering thus covering all of said stories, said earth covering extending downwardly and outwardly from the cover of said top story to a natural ground level and thus forming a naturally-sloping hill;

at least one protective room on each of said stories, each protective room being enclosed by shielded and radiation proof concrete walls;

said window-containing front wall projecting from the slope of said hill, and said protective rooms extending into said hill;

exits communicating with each of said stories and extending through said earth covering to open onto the slope of said hill;

a wall located in front of said wall of windows, said wall having on each story thereof loggia-like recesses fitted with preferably radiation proof roller blinds, hinged curtains or the like;

each of said exits from each of said stories comprising a substantially horizontal tunnel leading through said earth covering; and each said protective room being closed by means of a radiation- and gas-proof door which opens into said tunnel.

* * * * *